US006286447B1

(12) United States Patent
Beauchamp et al.

(10) Patent No.: US 6,286,447 B1
(45) Date of Patent: Sep. 11, 2001

(54) BAFFLE SYSTEM FOR MITIGATION OF THRUSTER WAKE DEFICIT

(75) Inventors: Charles H. Beauchamp, Jamestown; William H. Nedderman, Jr., Middletown, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/378,119

(22) Filed: Aug. 20, 1999

(51) Int. Cl.[7] ..... B63H 25/46
(52) U.S. Cl. ..... 114/151
(58) Field of Search ..... 440/38–42; 114/150, 114/151, 337, 338, 312, 330

(56) References Cited

U.S. PATENT DOCUMENTS 2,330,674 * 9/1943 Briggs ..... 114/151

FOREIGN PATENT DOCUMENTS

60391 * 3/1986 (JP) ..... 114/151

* cited by examiner

*Primary Examiner*—Ed Swinehart
(74) *Attorney, Agent, or Firm*—Michael L. McGowan; Prithvi C. Lall; Michael F. Oglo

(57) ABSTRACT

A baffle system for mitigating thruster wake deficit is provided in the environment of an underwater vehicle. The baffle system includes at least one baffle member initially housed within a thruster housing of the underwater vehicle and an actuating member for selectively positioning the at least one baffle member into a fluid flow over an outer surface of the underwater vehicle. The baffle members deflect the fluid flow from the thruster into surface contact with the outer surface of the underwater vehicle aft of the thruster housing on a discharge side thereof and directs the fluid flow into the thruster housing on an intake side thereof. The baffles may be as few as two and as many as four, and are selectively introduced into the fluid flow passing over the outer surface of the vehicle to direct the fluid flow accordingly.

15 Claims, 3 Drawing Sheets

BAFFLE SYSTEM FOR MITIGATION OF THRUSTER WAKE DEFICIT

CROSS REFERENCES TO RELATED PATENT APPLICATION

The instant application is related to a co-pending U.S. patent applications entitled PASSIVE SYSTEM FOR MITIGATION OF THRUSTER WAKE DEFICIT Ser. No. 09/378,119 having same filing date.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a baffle system for mitigating thruster wake deficit. More particularly, the invention relates to a baffle system for mitigating thruster wake deficit having extendable baffles which direct and thereby control boundary layer flow along an exterior surface of a vessel, and thereby improve maneuvering of the vessel.

(2) Description of the Prior Art

The current art for thrusters includes installation of a rotating propeller in a tunnel formed transversely through the vehicle. The rotating propeller creates a pressure differential across the propeller blades and drives a jet of water through the tunnel and out one side. The integrated pressure force on the propeller blades is transferred to the vehicle via a rotor hub as a force acting in a direction opposite to that of the jet flow. This effect is used to maneuver the vehicle. Even further, it is known in the art to design thrusters which are reversible thereby enabling maneuvering of the vehicle in either port or starboard directions.

Early efforts to measure the effects of forward vehicle velocity on tunnel thruster performance showed that as the forward velocity of the vehicle was increased to a speed on the order of 3 knots, the effective side force (force perpendicular to the longitudinal axis of the vehicle) from the tunnel thruster decreased to as low as 10 percent of the side force measured at zero forward vehicle velocity. Thus, a problem exists in the art whereby tunnel thrusters quickly lose their maneuvering effectiveness as forward vehicle velocity increases. Experiments conducted to understand this phenomenon indicated that it is not the forward velocity per se which significantly alters the force acting on the vehicle through the propeller hubs. Instead, the inventors of the present invention have discovered that the thruster jet acts as an obstruction to the boundary layer flow over the vehicle hull. More specifically, a wake deficit is created in the boundary layer downstream of the thruster jets. The resulting wake-induced pressure deficit on the vehicle surface generates an integrated suction force on the hull that counteracts the force on the blades. Conversely, on the suction side of the tunnel there is a high pressure stagnation region aft of the tunnel due to the vehicle boundary layer being sucked off by the thruster. The integrated force in this high pressure region also counteracts the force on the thruster blades.

Tunnel thrusters are typically reversible which means that the blades can be rotated clockwise or counterclockwise to produce a jet in either direction through the tunnel and thus provide force in either direction to maneuver the vehicle. Thus, any device that is deployed to mitigate the effects of forward velocity must also be reversible.

The following patents listed below, for example, disclose various types of tunnel thrusters for water vehicles, but do not disclose a baffle system for a tunnel thruster which will deflect water at the flow surface of the vehicle to assist in counteracting or minimizing the properties exhibited by the boundary flow layer due to the thruster jet, particularly at predetermined vehicle speeds. These patents are:

U.S. Pat. No. 3,008,443 to Blickle;

U.S. Pat. No. 3,408,974 to Pehrsson;

U.S. Pat. No. 3,710,748 to Baer et al.;

U.S. Pat. No. 3,797,447 to Stubblefield;

U.S. Pat. No. 3,830,184 to Krautkremer;

U.S. Pat. No. 4,018,181 to Brix;

U.S. Pat. No. 4,455,960 to Aker.

Specifically, the patent to Blickle discloses a device for covering transverse passages in ships. More specifically, the device is equipped with a propulsion elements arranged in the transverse passage. It is an object of the invention to provide a device for covering transverse passages in ships with a propulsion element in the passages, which will effectively protect the propulsion element against foreign floating bodies, even if the means for closing the transverse passage occupy their fully opened position. This patent makes no claims with reference to the decrease in effective thrust with forward speed, makes no reference to pressure differential across the hull, and does not disclose a system of baffles to deflect a portion of the flow to reduce the pressure differential across the hull and improve the effective force generated by the thruster.

The patent to Pehrsson discloses a ship steering system which includes tunnels extending transversely through a ship's hull at the bow or stern or both in which is mounted a reversing or reversible pitch propeller in order to pump water selectively through the tunnel to exert a steering force on the hull and including vanes or screens which can be extended outwardly from and withdrawn into the hull located behind the ends of the tunnel or tunnels in the direction of movement of the ship in order to exert a turning force on the hull and also to direct water selectively in the tunnel during the forward or rearward movement of the ship to enable control of the steering of the ship either at low or high speeds. Thus, Pehrsson fails to disclose a vane extending outward on the suction side of the thruster, or a system of baffles to deflect a portion of the discharge flow along the hull to reduce the pressure differential across the hull and improve the effective moment generated by the thruster.

Baer et al. discloses a steering device in which a longitudinal flow passage opens at the bow of a ship and has impeller means therein with first and second discharge flow passages branching from the longitudinal passage behind the impeller and opening on both sides of the hull. Controllable valve means in the discharge flow passages control the flow of water therethrough with the water being discharged from openings whose rear edges project outwardly of the hull surface a distance about one fourth of the width of the discharge opening. Accordingly, Baer et al. are directed to a thruster system with a longitudinal passage that opens at the bow, including controllable flap valves for directing the flow to one side of the ship or the other. An alternative is disclosed in which the controllable flap is positioned at the discharge opening. This does not refer to the decrease in effective thrust with forward speed, to pressure differential across the hull, or a system of baffles to deflect a portion of the flow to reduce the pressure differential across the hull and improve the effective force generated by the thruster. In fact the controllable flap as configured in FIG. 2 thereof would act to increase the pressure deficit downstream of the thruster jet and thus decrease the effective force of the thruster with forward velocity.

Stubblefield discloses an inboard propulsion system for a boat utilizing a water jet propulsion characterized by a pair of spaced nozzles each provided with individually controlled deflecting hoods to enable providing both a reverse thrust for backing the boat and to selectively reverse the water jet of a single nozzle to provide a turning force for steering the boat. Preferably, each of the nozzles is provided with a servo system which varies the effective opening of the nozzle in response to changes in the pressure differential between the intake pressure to the main impeller unit and the discharge pressure of the impeller unit to attempt to maintain a constant quantity flow from the nozzles independent or regardless of any variations in the intake pressure of the impeller unit. Thus, the reference is directed to a primary propulsion system for a boat located on the stern of the boat and to controlling deflector hoods backing or steering the boat. There is no reference to secondary tunnel thrusters extending laterally through the hull for maneuvering the boat at low speeds and no reference to a decrease in effective thrust with forward speed. No reference is made to pressure differential across the hull or a system of baffles to deflect a portion of the flow to reduce the pressure differential across the hull and improve the effective force generated by the thruster as in the present invention.

Krautkremer discloses an attachable or a detachable unit providing a lateral thrust rudder for ships. This reference includes a unitary mechanism constituting a tunnel, a propeller within the tunnel and driving means for the same which can be bodily mounted into or detached from a ship. When the mechanism is in an operating position, it is normally mounted at the bow of the ship and functions to apply a lateral thrust in one direction or the other to the bow. Preferably, the unit is so mounted that the driving mechanism projects into the interior of the ship for easy access thereto. Thus, the reference includes a thruster system that is designed and built separately from a ship hull and can be added or not as a separate component which is not an integral part of the ship. There is no reference to the decrease in effective thrust with forward speed or to pressure differential across the hull. There is no system of baffles disclosed to deflect a portion of the flow to reduce the pressure differential across the hull and improve the effective force generated by the thruster as occurs in the present invention.

Brix is directed to a lateral thrust control unit for watercraft having a pair of tunnels which are directed transversely to the longitudinal axis thereof. Each of the tunnels extend from one side of the watercraft the oppositely positioned side of the watercraft and have at least one drivable propeller therein. At least one pressure compensating channel is provided near the tunnels and connects at least one of the zones of the differing pressure fields created on the sidewalls of the watercraft as it moves simultaneously longitudinally and laterally to the pressure field of different potential to equalize the pressure differential there between and to reduce the resistance to the lateral movement. The pressure-compensating channels do not have any propulsion devices therein. Thus, Brix merely provides a pressure compensating channel to equalize the pressure differential and makes no reference to the decrease in effective thrust with forward speed. There is also no reference to a system of baffles to deflect a portion of the flow to reduce the pressure differential across the hull and improve the effective force generated by the thruster.

Aker is directed to a boat thruster system including a pump for drawing water through an inlet in the boat hull and for discharging water through first and second pipes connected to outlets located on either side of the hull. A valve is installed in each of the pipes to control the flow of water therethrough. The valves may be controlled by either an open or closed loop control system configured so as to prevent both outlet pipes from being closed at the same time during system operation. Each valve is preferably comprised of multiple vanes each of which is mounted for rotation about an off center axis such that in the event of a valve control system failure, the water flow will cause the valve to open rather than close thereby preventing undesirable high pressure buildup in the system. Aker does not refer to a decrease in effective thrust with forward speed or to pressure differential across the hull. Also, there is no reference to a system of baffles to deflect a portion of the flow to reduce the pressure differential across the hull and improve the effective force generated by the thruster as occurs in the present invention.

It should be understood that the present invention would in fact enhance the functionality of the above patents by diverting the flow of water at the surface of and thereby over the vessel hull, thus mitigating a surface pressure differential across the vehicle downstream of the thruster jet and thus eliminate the force which counteracts the force on the thruster blades. Further, the present invention provides the advantage that the effective control force produced by the tunnel thruster will not decrease significantly with forward speed on the vehicle. Thus, the performance of the thruster in maneuvering the vehicle with forward speed will be improved by this invention. The baffle feature directs the flow into and out of the tunnel thruster in a manner not previously recognized in the art.

SUMMARY OF THE INVENTION

Therefore it is an object of this invention to provide a baffle system for mitigating thruster wake deficit.

Another object of this invention is to provide a baffle system for mitigating thruster wake deficit which is operable in a range of vehicle speeds.

Still another object of this invention is to provide a system for mitigating thruster wake deficit in an underwater vehicle, thereby enhancing thruster operation over a wide range of vehicle speeds.

A still further object of the invention is to provide at least a pair of baffles in connection with a vehicle thruster mechanism.

Yet another object of this invention is to provide a baffles or a baffle system for mitigating thruster wake deficit which is simple to manufacture and easy to use.

In accordance with one aspect of this invention, there is provided a baffle system for mitigating thruster wake deficit in an underwater vehicle. The baffle system includes at least one baffle member initially housed within a thruster housing of the underwater vehicle and an actuating member for selectively positioning at least one baffle member into a fluid flow over an outer surface of the underwater vehicle. The baffle members deflect the fluid flow from the thruster into surface contact with the outer surface of the underwater vehicle aft of the thruster housing on a discharge side thereof and directs the fluid flow into the thruster housing on an intake side thereof.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to a baffle system for mitigating thruster wake deficit.

Marine vehicles are often required to maneuver at very low speeds and hover in currents. Marine vehicles typically use rudders or other control surfaces to produce maneuvering forces. However, flow over the control surfaces is required to produce a maneuvering force and these forces vary with the square of the vehicle speed. Therefore, at slow speeds, control surfaces become ineffective. Typically, lateral tunnel thrusters are located in the bow or stern of marine vehicles to meet the low speed maneuvering requirements. Unfortunately, the effectiveness of the tunnel thruster decreases with forward velocity of the vehicle. A problem exits in the art because there is an intermediate vehicle speed at which neither the control surfaces nor the thruster produce effective maneuvering forces. The inventors have solved this problem identified in the art by improving the control performance of tunnel thrusters at intermediate forward speeds and have thus filled the gap in maneuvering effectiveness.

More specifically, the basic principle of this invention is to mitigate the surface pressure difference across the vehicle downstream of the thruster jet and thus eliminate the force which counteracts the force on the thruster blades. This is accomplished by providing a pair of movable baffles on the thruster tunnel discharge/inlet as shown and described in the following.

Figure 1:
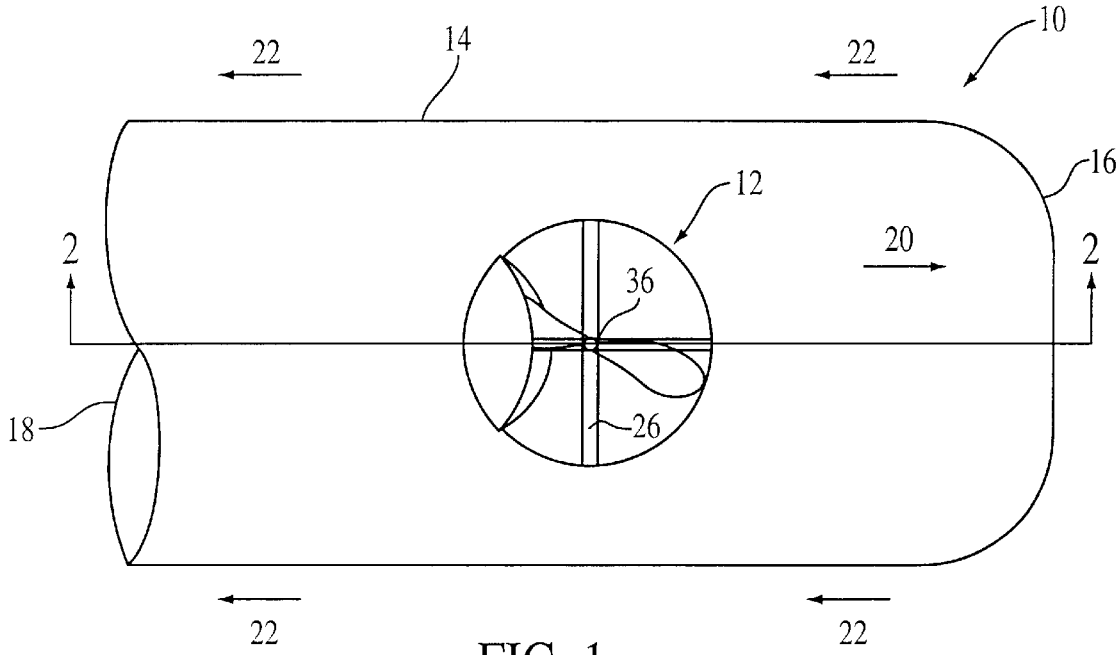
FIG. 1 is a side plan view of a first preferred embodiment of the present invention having a hinged baffle system with activated baffles.

Referring initially to the first embodiment of the invention, FIG. 1 illustrates a side view of a portion of a vehicle 10 having a thruster member 12 formed therethrough. The vehicle 10 more specifically includes an outer surface area 14 with the thruster member 12 being mounted through the vehicle 10 and perpendicular to a longitudinal axis of the vehicle 10. The vehicle 10 further includes a fore or forward end 16 and an aft or rearward end 18. The vehicle direction is depicted by arrow 20 and the corresponding flow of fluid during a vehicle forward movement is shown by arrows 22.

Figure 2:
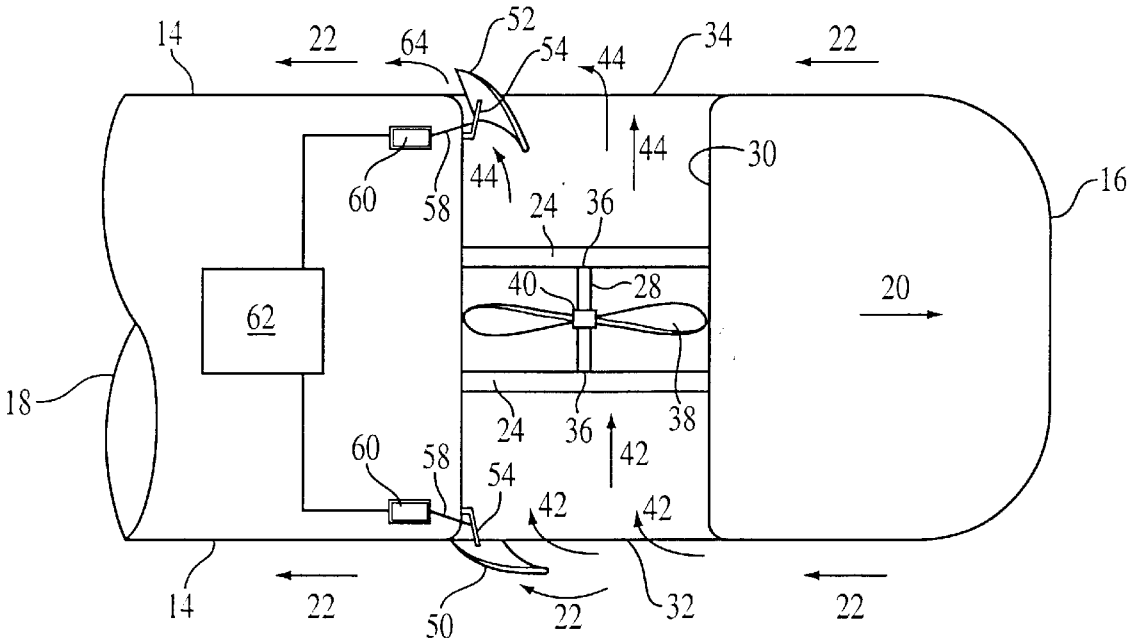
FIG. 2 is a sectional view taken along line 2—2 of FIG. 1.

Additional details of the invention appear in FIG. 2 as a sectional view taken along lines 2—2 of FIG. 1. In this illustration, the thruster 12 is more clearly shown as having an inner continuous wall portion 30 defining the primary flow path through the thruster 12. As shown, the thruster includes a starboard side 32 and a port side 34. It should be understood that the starboard side 32 and the port side 34 will interchangeably act as the intake side and the discharge side according to a selected course of the vehicle and the resultant operation of the thruster components as hereafter described. The thruster member 12 further includes a first pair of parallel and spaced apart cross bars 24 aligned with the longitudinal axis of the vehicle 10 and a second pair of parallel and spaced apart cross bars 26 intersecting with and perpendicular to the first pair of cross bars 24. Opposite ends of each of the first 24 and second 26 pairs of cross bars are fixed in a conventional manner to the inner wall 30 of the thruster housing 12. A secondary bar 28 is supported within the thruster housing 12 and perpendicular to the longitudinal axis of the vehicle 10 at an intersection 36 of the first 24 and second 26 pairs of cross bars. As such, the secondary support bar 28 is freely suspended within the thruster housing 12.

At least one rotating thruster blade 38 having a center point 40 is mounted to the secondary support bar 28 at the center point of the thruster blade 38. The rotating thruster blade 38 is oriented so as to reversibly rotate, thereby forcing fluid through the thruster housing 12 from a starboard side 32 to a port side 34 and also to reverse the fluid direction from the port side 34 to the starboard side 32.

Observing the flow directions in FIG. 2, as a sectional view taken along line 2—2 of FIG. 1, the flow is illustrated by way of example as being from intake flow 42 at the starboard side 32 to discharge flow 44 at the port side 34. In FIG. 2, there is further illustrated the baffle system or baffle of the present invention. In particular, there are two baffle members, 50 and 52 utilized in this embodiment of the invention. Each of baffle members 50, 52 is of a curved semicircle, each baffle being moveable between at least two positions. Each of baffle members 50, 52 is connected by a connector arm 54 to a hinged anchor member 56 on the inner wall 30 of the thruster 12. Further, an actuator arm 58 is connected at a first end thereof to an actuator mechanism 60 and at a second end thereof to the connector arm 54 for each of baffle members 50, 52. An automated control system 62 is electrically connected to the actuator mechanism 60 for directing the actuator arms 58 and thus the connector arms 54 with the baffle members 50, 52 mounted thereon.

In the event that the vehicle speed requires actuation of baffle members 50, 52 to mitigate the thruster wake deficit, and the thruster 12 is utilizing the starboard side 32 as the intake side and the port side 34 as the discharge side, the following will occur. On the discharge side 34 of the thruster tunnel 12, baffle member 52 is deployed to deflect a portion 64 of the fluid forced from the thruster jet on the discharge side 34 and aft along the body surface 14 of the vehicle 10 to fill in the wake deficit and eliminate a separation zone being naturally formed behind the thruster jet 12. On the suction or intake side 32 of the thruster tunnel 12, baffle member 50 is deployed to deflect flow 42 into the thruster tunnel 12. Baffle member 50 is shaped to move a stagnation point thereof to a leading edge of the baffle 50 and thus minimize the high pressure region on the hull surface 14 aft of the tunnel 12.

When the flow in thruster tunnel 12 is reversed so that the port side 34 becomes the intake side and the starboard side 32 becomes the discharge side, the positions of the baffles 50, 52 are reversed. That is, baffle 52 is moved to an intake scoop position and baffle 50 is moved to a discharge jet deflector position.

Figure 3:
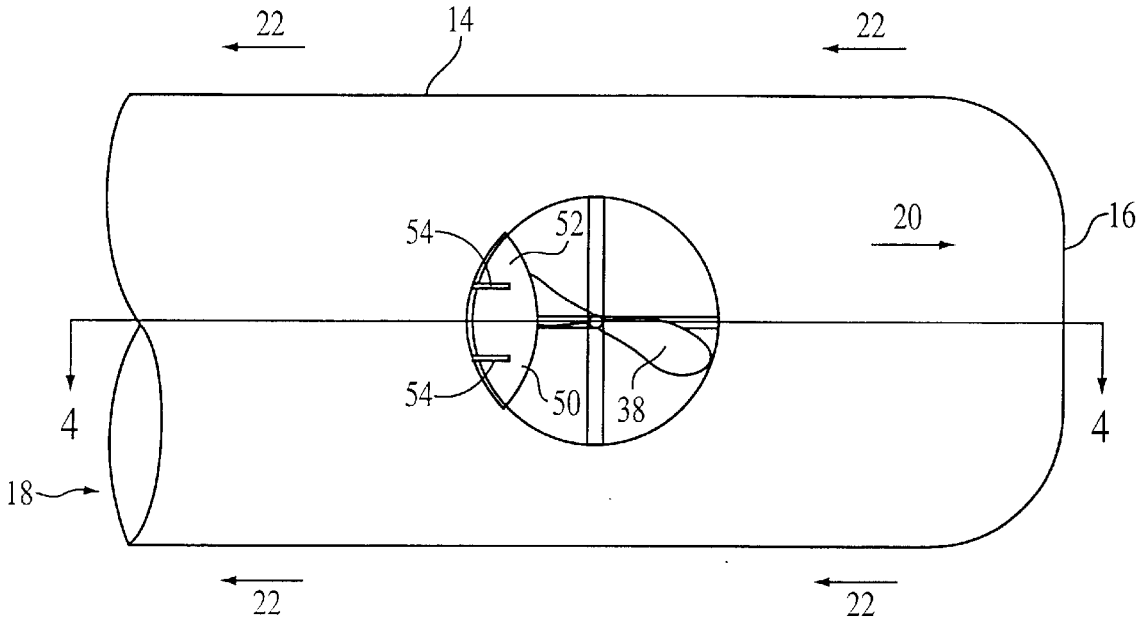
FIG. 3 is a side plan view of the first preferred embodiment of the present invention having stowed baffles.
Figure 4:
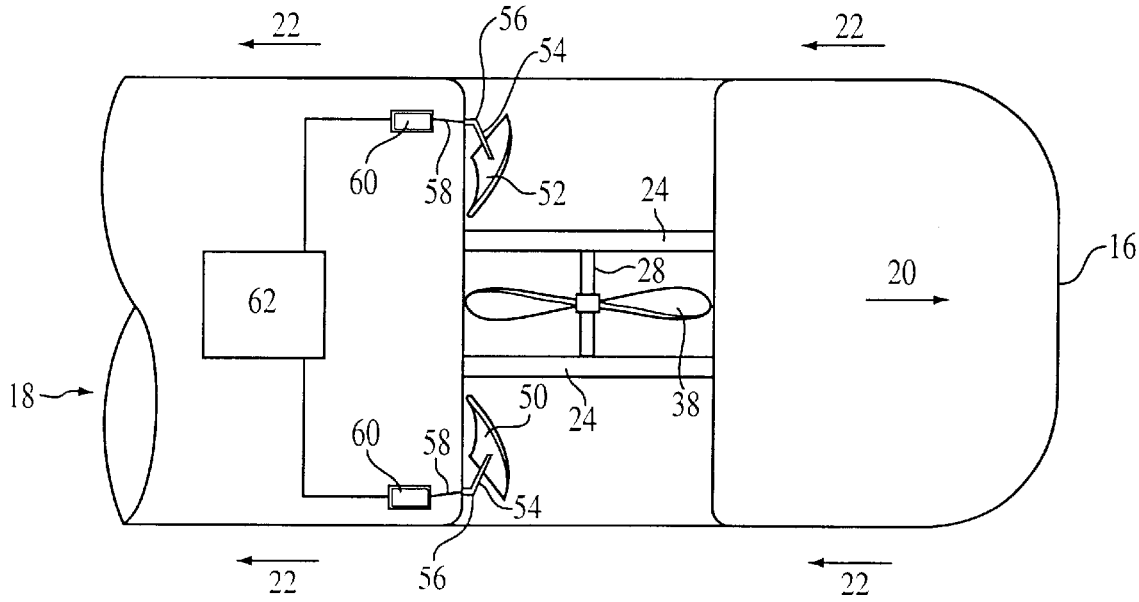
FIG. 4 is a sectional view taken along line 4—4 of FIG. 3.

When thruster 12 is not operating, both baffles 50, 52 are retracted into the thruster tunnel 12 for stowage as shown in FIGS. 3 and 4. When thruster 12 is operating but there is no forward velocity, baffle members 50, 52 are moved to a neutral position, substantially intermediate of scoop and stowed positions, where they will have a minimum impact on thruster performance.

In its simplest control configuration, each baffle 50, 52 has only four fixed positions: stowed, discharge deflector, intake scoop, and neutral. Baffle members 50, 52 are stowed when the thrusters were not operating. When thrusters are turned on and there is forward vehicle velocity, baffle members 50, 52 are moved into the respective positions: scoop on the intake side and deflector on the discharge side. There is only a single scoop and a single deflector position. When the thruster is on and there is no forward vehicle velocity baffle members 50, 52 are moved to a neutral position. In this case, actuating mechanisms 60 are either controlled manually or by the automated control system 62.

At the next level of control complexity, the exact position of baffle members 50, 52 is varied to an optimum position based on forward vehicle speed and truster speed. In this case baffle members 50, 52 are operated over a continuum of positions between fully stowed and fully extended into scoop and deflector positions. In this case, the baffle position is preferably controlled by the automated controller 62.

At the highest level of complexity, not only the position but also the shape (camber) of baffle members 50, 52 is optimized based on forward vehicle speed and thruster speed. The camber of baffle members 50, 52 is changed by internal embedded actuators, for example shape memory alloy wires. In this case the baffles are operated over a two-dimensional continuum of position and camber. The advantages of this complexity enable optimal performance at all conditions of vehicle and thruster speed. For example, in a neutral position, the camber is set to zero to minimize impact on thruster performance. Again, in this case, the baffle position and shape are preferably controlled by the automated controller 62 based on vehicle and thruster speed input.

Figure 5:
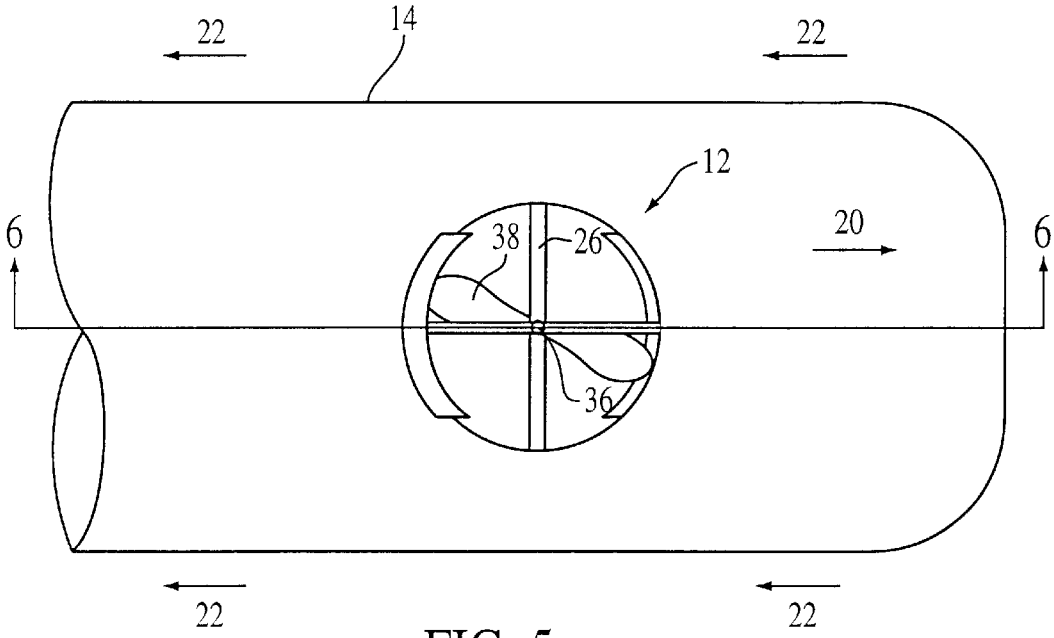
FIG. 5 is a side plan view of a second preferred embodiment of the present invention having a pop-out baffle system.
Figure 6:
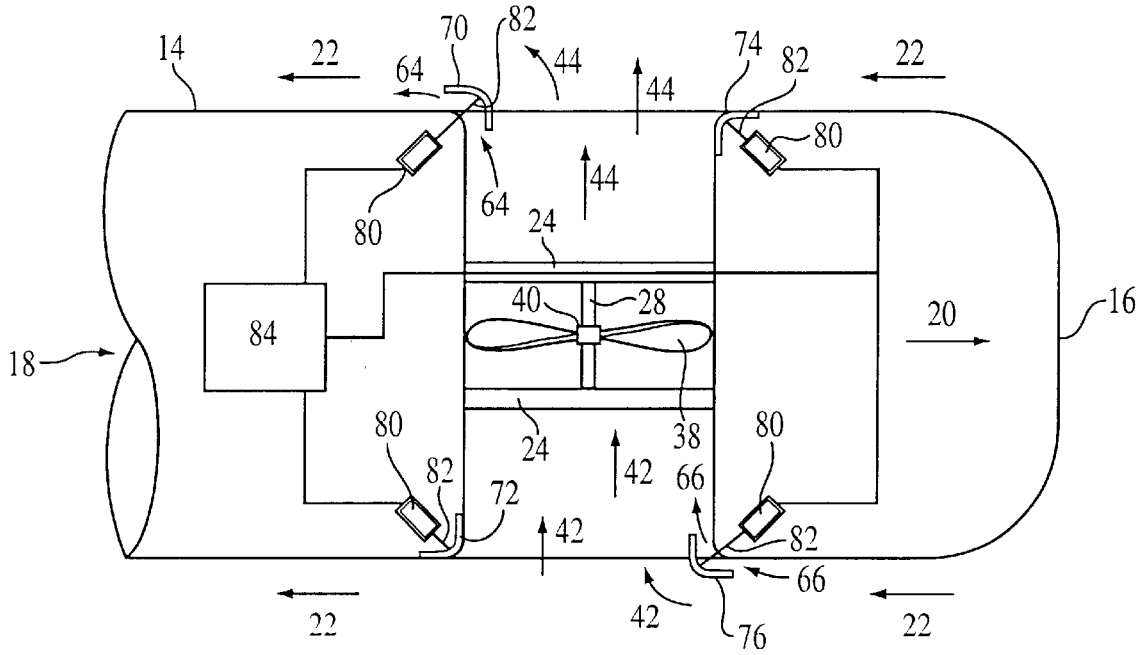
FIG. 6 is a sectional view taken along line 6—6 of FIG. 5.

An alternative embodiment of the present invention is shown in FIGS. 5 and 6. In this embodiment, all elements and purpose of the vehicle and thruster remain the same. A difference is found in the structure and position of the baffles. Each of four baffle members 70, 72, 74, and 76 is operated by a linear piston type actuator 80. The actuator is housed in the vehicle itself and is connected to a respective baffle member by a sliding piston 82. A first end of the sliding piston 82 is connected to actuator 80 and a second end of the sliding piston is connected to a respective baffle member 70, 72, 74, 76. Similar to the first embodiment, the actuators 80 are controlled by an automated control system 84.

In particular, the baffle members 70, 72, 74, 76 do not rotate from stowed to neutral to deflector to scoop positions but will simply pop out into the longitudinal flow of the fluid over the hull of the vehicle 10. As shown in FIGS. 5 and 6, there are a total of four baffle members 70, 72, 74 and 76 provided to control the fluid flow. For this alternative system, a baffle 76 will be popped out on the upstream (forward) and fluid intake side of the thruster tunnel 12 and a baffle 70 will be popped out on the downstream (aft) and discharge side of the thruster tunnel 12. Baffle members 76, 70 will have similar effects of directing the intake and discharge flow, respectively, to reduce the pressure differential across the vehicle 10. When the thruster direction is reversed, the baffle members are popped out in opposite edges of the tunnel 12. That is, baffles 70 and 76 are retracted to stowed positions and baffles 72 and 74 are popped out. More specifically, the protrusion of baffle 76 at the fore end of the thruster and on the starboard (intake in this instance) side of the vehicle 10 will direct a portion of the intake fluid as shown at 66, and the protrusion of baffle 70 at the diagonally opposite corner of the thruster housing 12 from the baffle 77 directs fluid as shown at 64. In the event that the fluid intake and discharge sides are reversed, baffle members 76 and 70 will be retracted while baffles 74 and 72 will protrude into the fluid flow.

With all four baffles 70, 72, 74, 76 in stowed position, there is nothing protruding into the thruster tunnel 12. Thus, the stowed position is also the ideal neutral position for operating the thruster 12 without forward vehicle speed. Another feature of this alternative embodiment is the simplicity of the actuation mechanism. This system only requires a linear actuator 80.

This alternative embodiment also includes three levels of control complexity. In the simplest configuration, each of baffle members 70, 72, 74, 76 has only two positions including stowed or activated. At the next level of complexity, baffle members 70, 72, 74, 76 are extendable to different positions to optimize performance depending on thruster and vehicle speed. These baffles, therefore, operate over a continuum of positions from stowed to fully extended. Finally, the highest level of complexity includes baffles having a variable shape (camber) as well as position. In this case baffle members 70, 72, 74, 76 are operated over a two-dimensional continuum of position and camber. The actuators are controllable either manually or by the automated control system 84.

By the present invention, lateral thruster control of an underwater vehicle is achieved in a more efficient manner than previously achieved in the art, the lateral thruster control eliminating the thruster wake deficit downstream of the thruster, thereby enabling vehicle control at all vehicle speeds.

While the invention has been described in terms of an underwater vehicle and the particular characteristics associated with the flow of fluid around the thruster housing, and how the same is controlled by the baffles as they are positioned therearound and selectively adjusted according to a speed and direction of the vehicle, it is anticipated that the invention herein will have far reaching applications other than those of underwater vehicles.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A baffle system for mitigating thruster wake deficit in an underwater vehicle, said baffle system comprising:

a plurality of baffle members initially housed within a thruster housing of said underwater vehicle, each baffle member thereof being selectively movable in a common direction; and an actuating member for selectively positioning at least one of said plurality of baffle members into a fluid flow over an outer surface of said underwater vehicle, said at least one baffle of said plurality of baffle members deflecting the fluid flow into surface contact with the outer surface of said underwater vehicle aft of the thruster housing on a discharge side thereof and directing the fluid flow into said thruster housing on an intake side thereof.

2. The baffle system according to claim 1 wherein said actuating member includes an automated control member, a hinged anchor member attached to an inner wall of said thruster member, a connector arm connected between the hinged anchor member and said baffle, an actuator mechanism operable in response to the automated controller, and an actuator arm interposed between the actuator mechanism and the hinged anchor member, wherein a signal from the automated controller is translated into movement of said baffle.

3. The baffle system according to claim 2 wherein each member of said plurality of baffle members is selectively movable to a common plurality of positions.

4. The baffle system according to claim 3 wherein said common plurality of positions include a stowed position, a neutral position, an intake scoop position, and a discharge deflector position.

5. The baffle system according to claim 1 wherein said actuating mechanism is manually actuated.

6. The baffle system according to claim 1 wherein said actuating mechanism is actuated automatically.

7. The baffle system according to claim 1 wherein said plurality of baffle members comprises two baffle member.

8. The baffle system according to claim 1 wherein said plurality baffle members comprises four baffle member.

9. The baffle system according to claim 1 wherein said actuating mechanism is a slide piston independently connected to each of said plurality of baffle members.

10. The baffle system according to claim 7 wherein said four baffle members are positioned such that a first baffle member is positioned on a starboard side of said vehicle and fore of said thruster, a second baffle member is positioned on the starboard side of said vehicle and aft of said thruster, a third baffle is positioned on a port side of said vehicle and fore of said thruster, and a fourth baffle is positioned on the port side of said vehicle and aft of said thruster.

11. The baffle system according to claim 10 wherein said first and fourth baffle members are extended into the fluid flow if said thruster has intake on the starboard side.

12. The baffle system according to claim 10 wherein said second and third baffle members are extended into the fluid flow if said thruster has intake on the port side.

13. The baffle system according to claim 10 wherein said plurality of baffle members are flush against said thruster housing in a retracted position.

14. The baffle system according to claim 10 wherein said plurality of baffle members are manually actuated.

15. The baffle system according to claim 10 wherein said plurality of baffle members are automatically actuated.

* * * * *